US012234635B2

(12) United States Patent
Åhsberg

(10) Patent No.: US 12,234,635 B2
(45) Date of Patent: Feb. 25, 2025

(54) METHOD AND DEVICE IN A FLOOR STRUCTURE DRYING PROCESS

(71) Applicant: Reddo Floor Solutions AB, Stockholm (SE)

(72) Inventor: Johan Åhsberg, Mollösund (SE)

(73) Assignee: Reddo Floor Solutions AB, Stockholm (SE)

( * ) Notice: Subject to any disclaimer, the term of this patent is extended or adjusted under 35 U.S.C. 154(b) by 689 days.

(21) Appl. No.: 17/439,102

(22) PCT Filed: Apr. 8, 2020

(86) PCT No.: PCT/SE2020/050365
§ 371 (c)(1),
(2) Date: Sep. 14, 2021

(87) PCT Pub. No.: WO2020/209779
PCT Pub. Date: Oct. 15, 2020

(65) Prior Publication Data

US 2022/0356701 A1 Nov. 10, 2022

(30) Foreign Application Priority Data

Apr. 9, 2019 (SE) ..... 1930117-5

(51) Int. Cl.
*E04B 1/70* (2006.01)
*E04G 23/02* (2006.01)

(52) U.S. Cl.
CPC ..... *E04B 1/7092* (2013.01); *E04G 23/0285* (2013.01)

(58) Field of Classification Search
CPC .... E04B 1/7092; E04B 1/7069; E04B 1/7076; E04G 23/0285; F26B 9/02
See application file for complete search history.

(56) References Cited

U.S. PATENT DOCUMENTS 5,048,242 A * 9/1991 Cline ..... E04F 15/02458 52/126.6
5,155,924 A 10/1992 Smith
5,459,897 A 10/1995 Wurdack
(Continued)

FOREIGN PATENT DOCUMENTS

DE 20200504 U1 5/2002

OTHER PUBLICATIONS

International Search Report and Written Opinion for corresponding International Application No. PCT/SE2020/050365 dated Jun. 8, 2020.

*Primary Examiner* — Jessica Yuen
(74) *Attorney, Agent, or Firm* — Renner, Otto, Boisselle & Sklar, LLP

(57) ABSTRACT

A method and device for holding a subsurface layer of an elevated flooring portion of a floor structure at a distance from a subfloor in a vicinity of an opening in the flooring portion during a process of drying the floor structure. According to the invention there is provided at least one rod having a substantially perpendicularly angled end. The rod is inserted below the subsurface layer through the opening and the angled end of the rod is attached to an edge of a surface layer in the opening of the flooring portion in a manner that the rod supports the subsurface layer at said distance from the subfloor when the flooring portion is elevated.

4 Claims, 3 Drawing Sheets

(56) References Cited

U.S. PATENT DOCUMENTS

| | | | |
|---|---|---|---|
| 5,813,139 | A | 9/1998 | Lillicotch |
| 10,106,977 | B2 | 10/2018 | Åhsberg et al. |
| 2003/0054753 | A1 | 3/2003 | Steneby et al. |
| 2009/0166280 | A1 | 5/2009 | Wichern |
| 2010/0170072 | A1 | 7/2010 | Elzey |
| 2017/0175401 | A1 | 6/2017 | Kell |

* cited by examiner

METHOD AND DEVICE IN A FLOOR STRUCTURE DRYING PROCESS

This application is a national phase of International Application No. PCT/SE2020/050365 filed 8 Apr. 2020, which claims priority to Swedish Application No. 1930117-5 filed 9 Apr. 2019, the entire disclosures of which are hereby incorporated by reference.

TECHNICAL AREA

This invention relates to a method of holding a subsurface layer of an elevated flooring portion in a floor structure at a distance from a subfloor in a vicinity of an opening in the flooring portion during a process of drying the floor structure.

BACKGROUND

When drying a floor structure using an elevated flooring portion including a flexible subsurface layer, as disclosed in U.S. Pat. No. 10,106,977, there is a likelihood that the surfaces in the floor structure below and above the subsurface layer will either be too dry or not properly dried unless measures are taken in this regard. More precisely, if the subfloor surface below the subsurface layer is not sufficiently dried when the subsurface layer is resting on a subfloor, microbial growth may occur, and if the drying process then is enhanced to sufficiently dry that surface, the surface layer above may instead be damaged by overdrying. To overcome this problem, said U.S. Pat. No. 10,106,977 suggests that the subsurface layer is intermittently attached at patches to the bottom of the surface layer in vicinity of the opening, so that the drying airflow will also enter a ventilating space above the subsurface layer, in addition to the ventilating space below the subsurface layer. This measure, however, has shown to be cumbersome and unreliable.

DISCLOSURE OF THE INVENTION

An object invention is to provide a method and device that eliminates the above mentioned problems in the prior art of drying an elevated flooring portion having a subsurface layer.

In an aspect of the invention the method is further comprised by

- providing a rod having a substantially perpendicularly angled end;
- inserting the rod below the subsurface layer through the opening; and
- attaching the angled end of the rod to an edge of a surface layer in the opening of the flooring portion in a manner that the rod supports the subsurface layer at said distance from the subfloor when the flooring portion is elevated.

Thereby two air gaps will be exposed in the opening when dry air is forced into the opening in the flooring. Accordingly, the dry air will flow along the floor structure both below and above the subsurface layer.

The attaching of the angled end to the edge of the surface layer may be performed by releasable fasteners such as screws.

By making the distance from the subfloor to the subsurface layer larger than a distance from the subsurface layer to the surface layer of the floor structure, more dry air will flow below than above the subsurface layer so that the surface layer can be prevented from being over dried before the subfloor is sufficiently dried.

The distance from the subfloor to the subsurface layer may be an average distance due to a flexible nature of the subsurface layer. More precisely, as the subsurface layer is often flexible, it will depend in areas outside the rod (or between rods when, for example four rods are attached in the opening). In that case the subsurface layer may even be clamped against the surface layer at least by a forward tip of the rod(s).

Specifically, the distance from the subfloor to the subsurface layer may be more than twice the distance from the subsurface layer to the surface layer.

Other features and advantages of the invention are apparent from the detailed description and the appended claims.

DETAILED DESCRIPTION OF EMBODIMENTS

Figure 1:
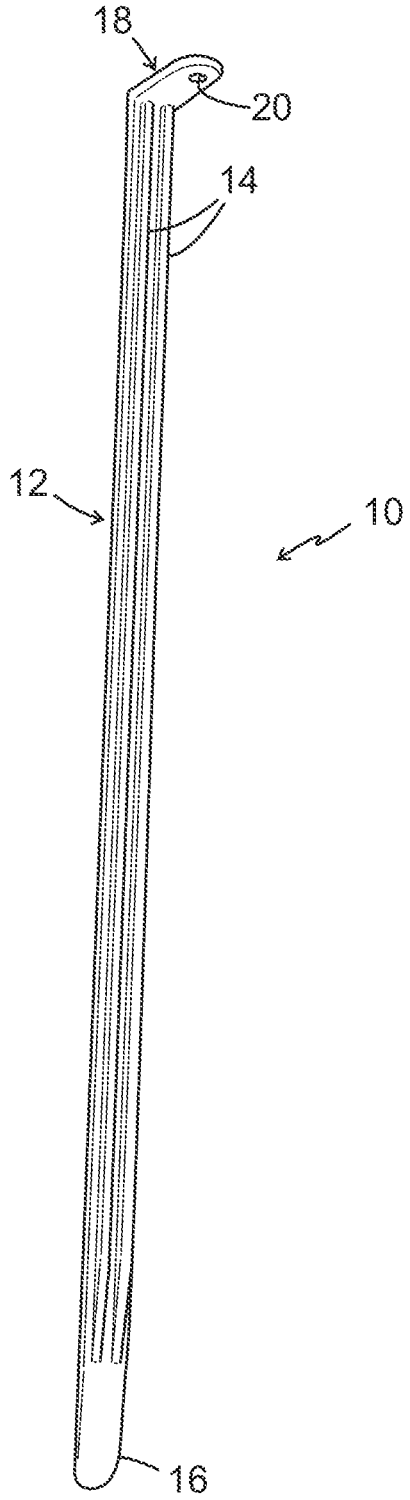
FIG. 1 is an oblique view of a device according to the invention.

The device according to the invention shown in FIG. 1 comprises a rod 10 having an elongated main portion 12 and a substantially perpendicularly angled end 18. In the exemplary embodiment shown, the main portion 12 has a flattened shape and is on a top face provided with one or more stiffening ridges 14 extending to a tapered forward portion 16 for facilitating insertion yet to be described. The rod 10 may typically have a length of about 30 centimeters and be made of any suitable durable and relatively stiff and resilient material such a synthetic resin or a formed metallic sheet material.

Figure 3:
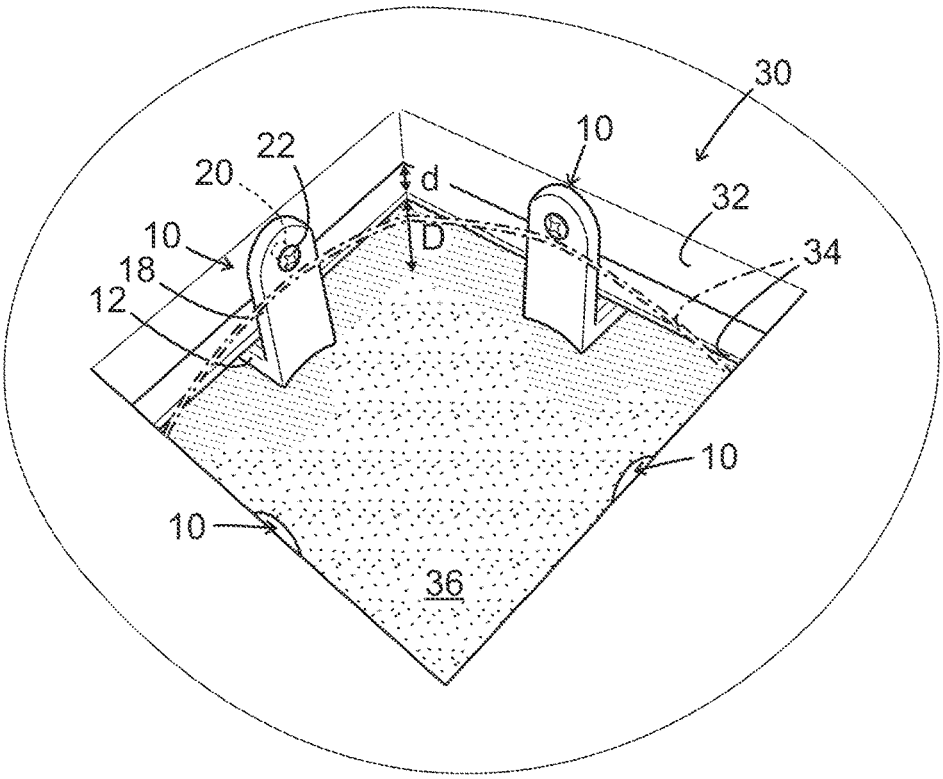
FIG. 3 is a view corresponding to FIG. 2 showing four devices being inserted in an elevated flooring and attached to a surface layer of the flooring.
Figure 4:
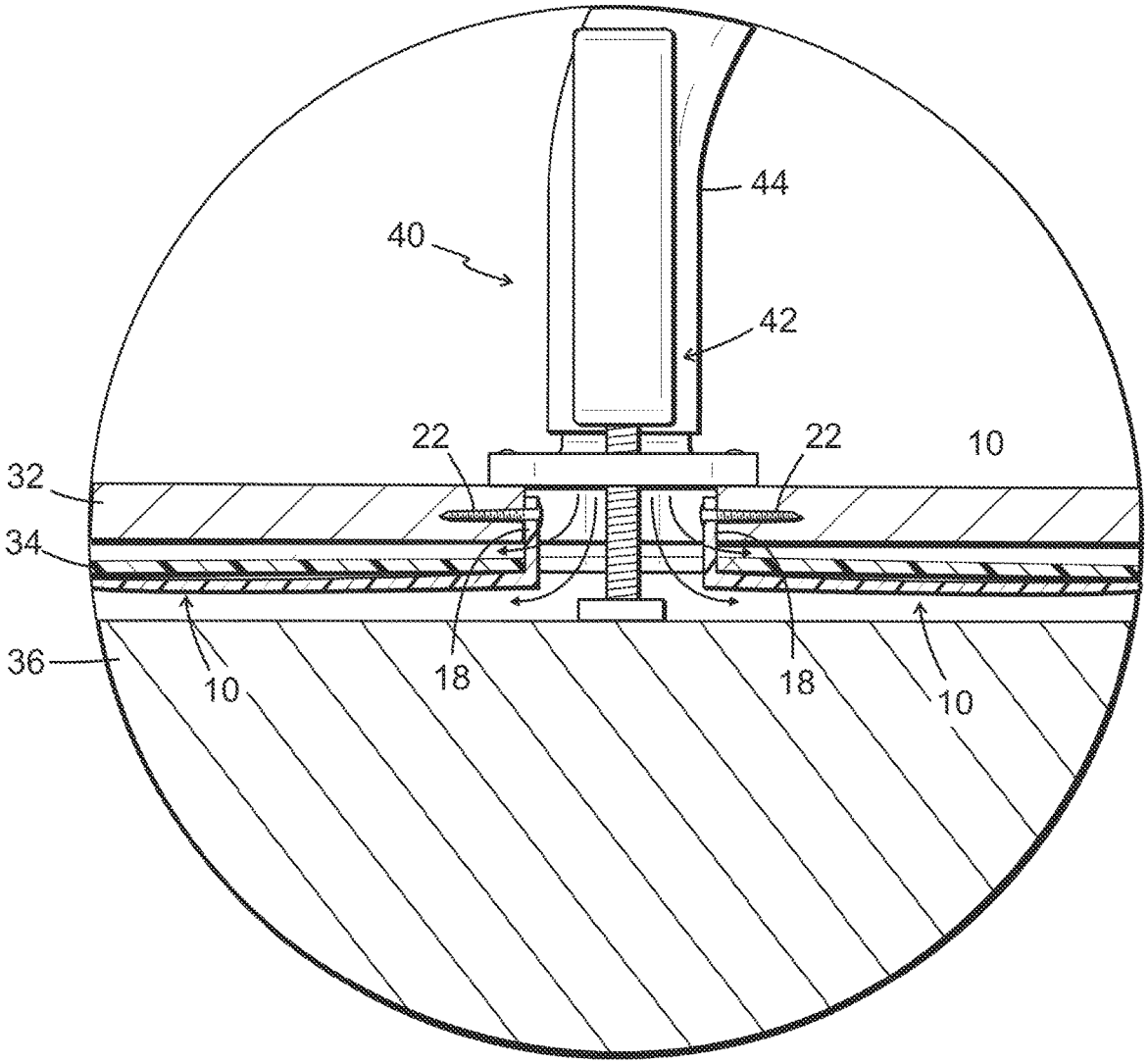
FIG. 4 is a partial section view showing a pair of devices according to the invention attached to an elevated flooring surface layer during a drying process.

The angled end 18 has an aperture or a screw hole 20 therethrough for attaching the rod 10 by a screw 22 to an edge of a closed opening in a flooring 30 as illustrated in FIGS. 3 and 4.

Figure 2:
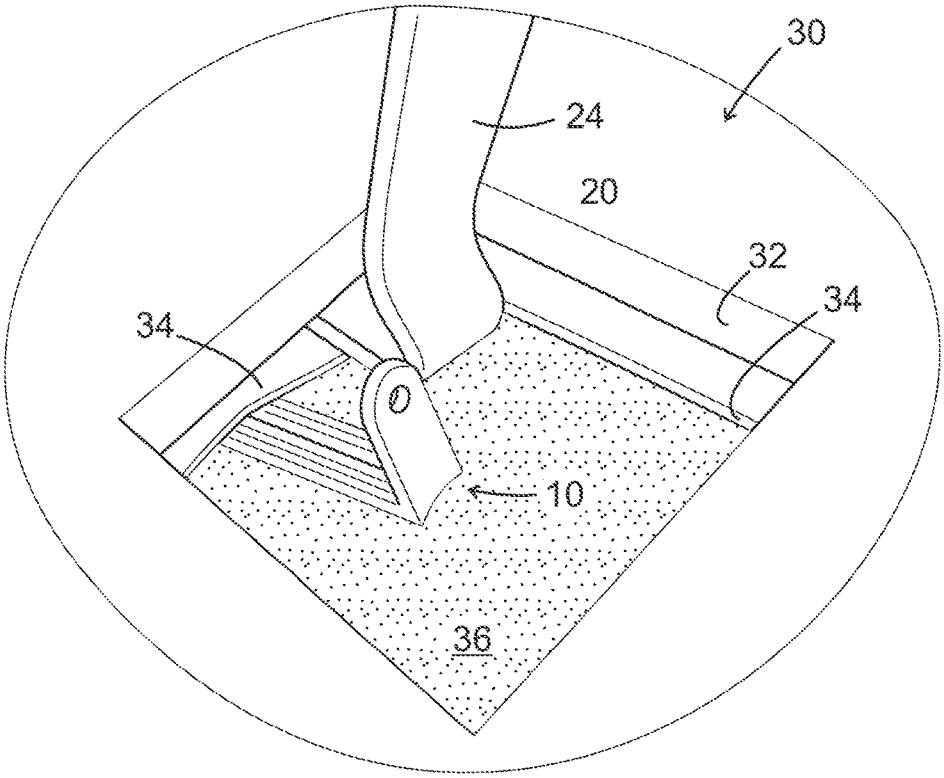
FIG. 2 is a partial perspective view showing a device of FIG. 1 during insertion in the flooring.

FIG. 2 shows a rod 10 being inserted in the closed opening that cut out from the flooring 30, for example by sawing. In the exemplary embodiment shown, the flooring 30 has a stiff surface layer 32, such as a wooden parquet layer, and a flexible subsurface layer 34, such as a step sound attenuating foam layer or a damp proofing sheet layer. The flooring 30 is resting on a subfloor 36 that may be of various types, for example a concrete subfloor. To facilitate insertion of the rod 10 below the subsurface layer 34, the surface layer 32 is elevated by means, for example, of a small crowbar 24 inserted between the subsurface layer 34 and the surface layer 32.

The surface layer is elevated so far that the angled end 18 of rod 10 may be attached by screw 22 to a center portion of an edge of the opening in the surface layer 32 as illustrated in FIG. 3.

As further illustrated in FIG. 3, one or more additional rods 10 may be attached in the same manner around the opening in the surface layer 32. For explanatory purposes, FIG. 3 also shows the flooring 30 being further elevated to a level where the floor structure is being dried. The subsurface layer 34 is then supported by the rods 10 at an average distance d of typically about 5-25 millimeters from the surface layer 32, whereby an average distance D between the subsurface layer 34 and the subfloor may typically be about 20-40 millimeters. These average distances are typically due to the flexible nature of the subsurface layer 34 as diagrammatically illustrated by phantom lines in FIG. 3, showing the subsurface layer 34 depending in areas between the rods 10.

As illustrated in FIG. 4, the flooring 30 is thus elevated by an adapter 10 attached to the surface layer including an elevating device 42 for pushing the surface layer 32 away from the subfloor 36. In the drying process dry air is forced via tubing 44 through the opening in the flooring and into the respective gaps or ventilating spaces maintained above and below the subsurface layer 34 by the rods 10.

Figure 5:
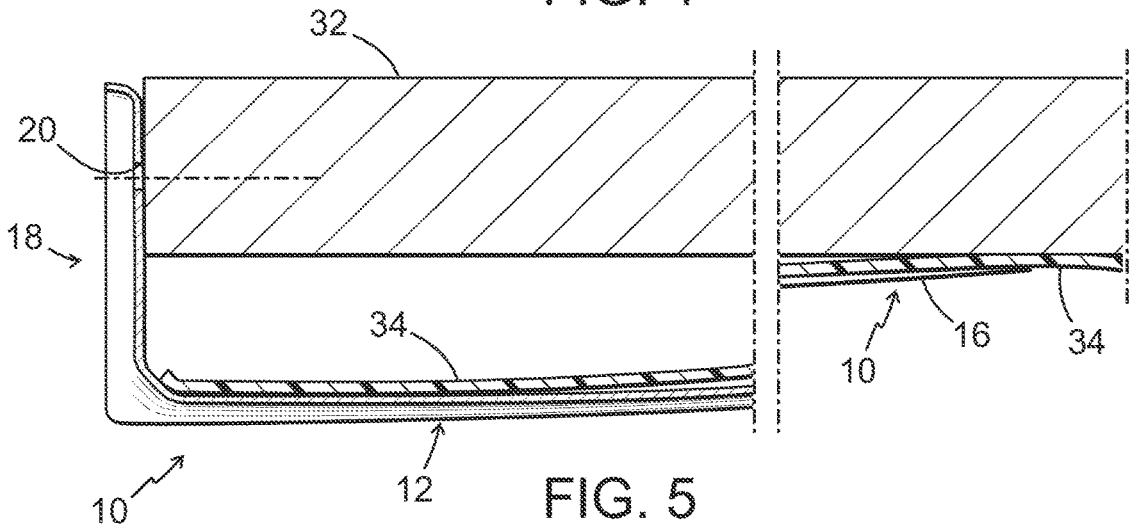
FIG. 5 is a partial section view of an alternative embodiment of a device according to the invention.

As indicated in FIG. 5, which shows rear and forward portions of a formed thin sheet metal embodiment of a rod 10, to minimize weight and material, the rod may also be slightly oriented or curved upwards from the angled end 18 to the forward portion 16, for the resilient rod 10 to keep the distance to the subfloor when loaded by the weight of the subsurface layer 34. In all embodiments of rods, the flexible subsurface layer 34 may also abut the surface layer 32 close to the rod(s), at least at the forward portion 16 of the rod(s) 10.

When the drying process is completed, the adapter 40 and the rods 10 are removed, and the opening may be sealed by a suitable lid (not shown) or by other means of restoring or repairing the surface layer. More details of the drying process are described in the above referenced prior art document U.S. Pat. No. 10,106,977.

The foregoing detailed description is given primarily for clearness of understanding and no unnecessary limitations are to be understood therefrom. Modifications will become obvious to those skilled in the art upon reading this disclosure and may be made without departing from the scope of the appended claims.

The invention claimed is:

1. A method for drying a floor structure having at least one subfloor, one subsurface layer and one surface layer, and holding the subsurface layer of an elevated flooring portion of the floor structure at a distance from the subfloor in a vicinity of an opening in the flooring portion during the process of drying the floor structure, the method comprising:

providing a rod having a substantially perpendicularly angled end, the angled end having an aperture therethrough;

inserting the rod below the subsurface layer through the opening;

attaching the angled end of the rod, using the aperture and a releasable fastener, to an edge of the surface layer in the opening of the flooring portion such that the rod holds the subsurface layer at said distance from the subfloor, and at a distance from the surface layer, thereby allowing dry air into two air gaps or ventilation spaces, arranged above and below the subsurface layer, when the flooring portion is elevated further.

2. The method of claim 1, wherein the attaching is by screwing.

3. The method of claim 1, comprising the step of making the distance from the subfloor to the subsurface layer larger than the distance from the subsurface layer to the surface layer of the floor structure, thereby making more dry air flow below than above the subsurface layer preventing the surface layer from being over dried.

4. The method of claim 3, comprising the step of making said distance from the subfloor to the subsurface layer more than twice the distance from the subsurface layer to the surface layer.

* * * * *